US005198666A

United States Patent [19]

Bateman

[11] Patent Number: 5,198,666

[45] Date of Patent: Mar. 30, 1993

[54] MASS SPECTROMETER HAVING A MULTICHANNEL DETECTOR

[76] Inventor: Robert H. Bateman, 15 Lynton Close, Knutsford, Cheshire WA16 8BH, England

[21] Appl. No.: 777,355

[22] PCT Filed: Jun. 1, 1990

[86] PCT No.: PCT/GB90/00844

§ 371 Date: Dec. 2, 1991

§ 102(e) Date: Dec. 2, 1991

[87] PCT Pub. No.: WO90/15433

PCT Pub. Date: Dec. 13, 1990

[30] Foreign Application Priority Data

Jun. 1, 1989 [GB] United Kingdom ..... 8912580

[51] Int. Cl.[5] ..... H01J 49/02; H01J 49/48

[52] U.S. Cl. ..... 250/294; 250/305; 250/396 R; 250/296

[58] Field of Search ..... 250/296, 294, 305, 396 R

[56] References Cited

U.S. PATENT DOCUMENTS

| | | |
|---|---|---|
| 3,407,323 | 10/1968 | Hand . |
| 3,636,345 | 1/1972 | Hirschel . |
| 4,912,326 | 3/1990 | Naito . |

FOREIGN PATENT DOCUMENTS

| | | |
|---|---|---|
| 0202117 | 11/1986 | European Pat. Off. . |
| 2648466 | 4/1978 | Fed. Rep. of Germany . |
| 3922996 | 2/1990 | Fed. Rep. of Germany . |
| 2620858 | 3/1989 | France . |
| 61-161645 | 7/1986 | Japan . |
| 61-206155 | 9/1986 | Japan . |
| 61-253760 | 11/1986 | Japan . |
| PCT/US83/-00862 | 12/1983 | PCT Int'l Appl. . |
| WO89/12315 | 12/1989 | PCT Int'l Appl. . |
| 851547 | 12/1981 | U.S.S.R. . |
| 1091257 | 7/1984 | U.S.S.R. . |
| 2216331 | 4/1989 | United Kingdom . |
| 2221566 | 2/1990 | United Kingdom . |

OTHER PUBLICATIONS

Matsuda, "Electrostatic Analyzer with Variable Focal Length", published on The Review of Scientific Instruments 1961 vol. 32 (7) pp. 850–852.

Matsuda, "Electric Field In Cylinder Condensers of Finite Length", published on International Journal of Mass Spectrometry and Ions Physics, 22 (1976) pp. 95–102.

Zashkvara, Korsunshii, "An Electrostatic Analyzer with Electrodes On Which The Potential Is Linearly Distributed", published on Soviet Physics-Technical Physics 1963 vol. 7 (7) pp. 614–619.

(List continued on next page.)

*Primary Examiner*—Jack I. Berman

*Attorney, Agent, or Firm*—Merchant & Gould, Smith, Edell, Welter & Schmidt

[57] ABSTRACT

The invention typically provides a double focusing mass spectrometer comprising an ion source (55), an ion momentum analyzer (56), a multichannel detector (58) and a multielectrode electrostatic ion-energy analyzer (57), wherein the energy dispersing field is generated by arrays of electrodes disposed in groups above and below the ion beam. By appropriate selection of the potentials applied to the electrodes, the focusing properties of the analyzer can be changed, allowing different extents of the mass spectrum to be accurately focused on the face of the detector (58) as it is tilted by the actuator (61) at different angles to the ion beam (64) emerging from the analyzer (57). This enables the spectrometer to simultaneously record either a small part of a mass spectrum at high resolution or a larger part at a lower resolution. Alternative arrangements of the detector which allow a similar result to be obtained are also disclosed.

15 Claims, 8 Drawing Sheets

OTHER PUBLICATIONS

Dymovich, Sysoev, "Calculation and Some Ion-Optical Characteristics of an Electrostatic Focussing System", published on Physical Electronics (Moscow) 1965, vol. 2, pp. 15-26, an English translation is enclosed.

Dymovich, Sysoev, "Calculation of the Field of an Electrostatic Focussing System and Modelling in an Electrolytic Bath", published on Physical Electronics (Moscow) 1965, vol. 2, pp. 27-32, an English translation is enclosed.

Dymovich, Dorofeev, Petrov, "Triple Focusing Crossed Field Mass Spectrometer", published on Physical Electronics (Moscow) 1966 vol. 3, pp. 66-75, an English translation is enclosed.

Daukeev, Karetskaya, Kasymov, Kelman, Mit[1], Saichenko, Shevelev, "Secondary-ion mass spectrometer", published on Soviet Physics Technical Physics Mar. 1985, No. 3, Woodbury, N.Y., USA.

Curtis, Hsieh, "Compact Wide-Aperture Hyperbolic Analyzers", published on Review of Scientific Instruments 59 (1988) Nov., No. 11, New York, NY, USA.

Gibson, Reid, "A Modified Fountain Spectrometer for Measuring Double Differential Cross Sections in Ion-atom collisions", published on J. Phys. E: Sci Instrum., vol. 17, 1984, pp. 1227-1230.

Kelman, Rodnikova, Finogenov, "Prism Mass Spectrometer With Energy Focusing", published on Soviet Physics-Technical Physics 1971 vol. 16 (1) pp. 130-135.

MASS SPECTROMETER HAVING A MULTICHANNEL DETECTOR

This invention relates to a mass spectrometer incorporating an electrostatic ion energy analyzer and a multichannel focal-plane detector.

If the single channel detector of a conventional scanning type mass spectrometer is replaced by a multichannel detector disposed in the focal plane of the final analyzer it is possible to record more than one mass-to-charge ratio simultaneously and therefore increase the efficiency of the spectrometer In other words, more of the ions formed from the sample may be detected in a given time so that the sensitivity is increased. In practice, however, the advantage that can be obtained is usually well below expectations.

In a spectrometer incorporating a conventional sector type electrostatic analyzer, this is partly due to the limitations imposed on a multichannel detector by the sector analyzer. Firstly, because of the limited spacing between the electrodes, the extent of its focal plane is limited, so that the range of masses that can be simultaneously imaged is also limited. Secondly, the focal plane of a sector analyzer is not usually perpendicular to the direction of travel of the ions leaving it, but inclined at a shallow angle. This further limits the maximum extent of the spectrum which can be simultaneously recorded and complicates the design of the detector system. Further, because a conventional analyzer comprises only 2 electrodes, the electrostatic analyzing field is determined entirely by the shape of the electrodes. This means that the homogeneity of the field cannot be varied and the number of aberrations (eg focal plane tilt and curvature) which can be corrected is very limited. Similarly, although a greater portion of the spectrum can be transmitted by use of an analyzer with a wider gap, it is then necessary to increase the height of the plates to ensure that the field in the vicinity of the ion beram is sufficiently uniform, which results in a very large and prohibitively expensive analyzer.

Another limitation on performance is that the spacing between the channels on currently available multichannel detectors is such that it is not possible to record a complete high resolution spectrum on a detector of reasonable length. A variable dispersion mass spectrometer which can image on the same detector either a small portion of the spectrum at high resolution or a larger portion at Iow resolution is therefore desirable, but because dispersion is determined by the geometrical parameters of the analyzers this is not easily implemented, especially if accurate double-focusing is to be achieved at all dispersions. One solution to this problem, proposed in PCT application publication number 89/12315, is an arrangement wherein the magnification of the electrostatic analyzer is substantially zero, which permits the use of a "variable radius" electrostatic analyzer while maintaining double focusing, thereby allowing the dispersion to be changed.

Very few electrostatic analyzers are known which do not rely on the field generated between two accurately shaped electrodes to define the energy dispersing field. Auxiliary electrodes are used in prior analyzers to compensate for the effect of fringing fields where the charged-particle beam enters and leaves the analyzer, but these do not define the main analyzing field. In these analyzers, one or more electrodes are provided at the entrance and exit of the analyzer and are maintained at potentials such that the field between the main electrodes is maintained as close as possible to the ideal field (eg, a 1/r field in the case of a cylindrical sector analyzer). Similar fringing-field corrector electrodes may be provided around the edges of a parallel-plate analyzer, (see, for example, Stolterfoht in DE2648466 A1).

Matsuda (Rev. Sci. Instrum. 1961, vol 32(7), pp 850–852) has described a variable focal length cylindrical sector analyzer which comprises a pair of conventional sector electrodes and a pair of planar auxiliary electrodes, respectively disposed. Above and below the sector electrodes (ie, displaced along the "z" axis). Application of a potential difference between these electrodes results in curvature of the equipotential surfaces along the "z" axis so that the analyzer exhibits some focusing in the "z" direction A similar concept is disclosed in JP 61-161645 Al (1986). Matsuda also suggests replacing each of the planar auxiliary electrodes with a number of wires disposed in concentric circular arcs and applying different potentials to each wire in order to correct aberrations, but does not give details as to how this might be achieved in practice. In a later paper (Int. J. Mass Spectrom Ion Phys., 1976, vol 22, pp 95–102), Matsuda suggests using the auxiliary electrodes in conjunction with shims on the main electrodes to reduce the height of the main electrodes needed to obtain adequate field homogeneity. In all these analyzers however, the field in the analyzer is principally determined by the main sector electrodes.

Zashkvara and Korsunshii (Sov. Phys. Tech. Phys. 1963 vol 7(7) pp 614–619) describe an electrostatic energy analyzer which has focusing properties along both the "y" and "z" axes in which the main field-defining electrodes are disposed either side of the charged-particle beam along the Y-axis and comprise a stack of flat cylindrical sector electrodes insulated from each other. A resistive potential divider is used to feed each plate electrode with an appropriate potential. In this way an inhomogeneous field along the analyzer "z" axis can be created and the focusing properties of the analyzer adjusted in a similar way to the Matsuda analyzer. The Zashkvara analyzer does not incorporate any electrodes displaced from the charged-particle beam along the "z" axis.

Dymovich and Sysoev describe (Phys. Electronics, Moscow, 1965, vol 2, pp 15–26 and 27–32) an electrostatic analyzer which is very similar to that proposed by Matsuda. This analyzer comprises two groups of circular arc electrodes disposed one above and one below the ion beam, and two circular main electrodes in a conventional location on either side of the ion beam. The analyzer, intended for use in a crossed-field mass spectrometer, is described in considerable detail Second and higher order aberrations are corrected by adjusting the potential gradient across the series of auxiliary electrodes in a similar way to that suggested by Matsuda. The analyzer as described involved no less than 76 circular arc electrodes (of different radii) and does not seem to have been adopted in any practical instrument, presumably due to the difficulty of its manufacture. A complete crossed-field mass spectrometer incorporating this electrode structure (called a "multi-electrode electrostatic focusing system, or EFS" by its designers) is described in a later paper (Dymovich, Dorofeev, and Petrov (Phys. Electronics, Moscow, 1966, vol 3, pp 66–75), but according to Soviet Inventors Certificate 851547 (1981) this instrument was found to be somewhat impractical due to the large size of the electrode structure. The solution proposed in SU 851547 is to form the circular arc electrodes as metallic deposits on a resistive substrate which is easier to manufacture, but removes one of the advantages proposed for the EFS in that the potential gradient between the electrodes is determined by the resistive substrate and cannot easily be adjusted to correct higher order aberrations.

It is an object of the present invention to provide an improved mass spectrometer with an electrostatic analyzer and a multichannel detector which is easy and cheap to construct.

It is another object of the invention to provide various types of double-focusing mass spectrometer with a multichannel detector wherein the extent of the mass spectrum simultaneously imaged on the detector can be varied.

The invention provides a mass spectrometer comprising an ion source, an ion momentum analyzer, an electrostatic ion energy analyzer and a multichannel detector locatable in the image focal plane of said electrostatic analyzer and capable of recording at least a portion of the mass spectrum of the ions entering it, wherein said electrostatic analyzer comprises an upper and a lower group of spaced-apart electrodes respectively disposed above and below the ion beam passing through it, each said group of electrodes comprising a pair of electrodes between which one or more central electrodes are disposed, the potentials of one electrode being more positive and the other electrode of the pair being more negative than the potential at which ions comprised in said ion beam enter said electrostatic analyzer and the potentials of all the electrodes comprising each said group progressively increasing from one electrode to the next, thereby providing an electrostatic field in a central plane between said groups which is capable of deflecting said ions along different curved trajectories according to their energy, and wherein the potentials of said electrodes are further selected so that said image focal plane is coincident with said multichannel detector over at least a substantial portion of the length of said detecter.

The potentials may be further selected to cause a selected extent of said mass spectrum to be imaged on said detector.

Viewed from another aspect the invention provides a mass spectrometer comprising an ion source, an ion momentum analyzer, an electrostatic ion-energy analyzer and a multichannel detector locatable in the image focal plane of said electrostatic analyzer and capable of recording at least a portion of the mass spectrum of the ions entering it, wherein said electrostatic analyzer comprises two groups of spaced-apart electrodes respectively disposed above and below the ion beam passing through it, each said group of electrodes comprising a pair of electrodes between which one or more central electrodes are disposed, the potentials of each electrode of said pair being respectively more positive and more negative than the potential at which ions comprised in said ion beam enter said electrostatic analyzer and the potentials of all the electrodes comprising each said group progressively increasing from one electrode to the next, thereby providing an electrostatic field in a central plane between said groups which is capable of deflecting said ions along different curved trajectories according to their energy, and wherein the potentials of said electrodes are being further selected to adjust the extent of the mass spectrum imaged on a given length of said detector.

Preferably the electrodes comprising each group are arrayed in a plane parallel to said central plane and spaced from adjacent electrodes in the same group by a gap of constant width over their entire length. Further preferably, the upper and lower groups of electrodes are substantially identical with an electrode in one group being maintained at the same potential as the electrode in a corresponding position in the other group. Most conveniently the electrodes are linear, and are disposed substantially parallel to each other, but it is also within the scope of the invention to use curved electrodes.

Conveniently, the potential of one of said central electrodes of each group is maintained at a potential $V_M$ and the potential of the other electrodes is given by a polynomial expression, eg $$V_E = V_M + V_A y_E + V_b y_E^2 + V_C Y_E^3 + V_D y_E^4 + \quad (1)$$

in which $V_E$ is the potential of a particular electrode, $y_E$ is the distance of that electrode from the electrode, maintained at the potential $V_M$ (positive in one direction, negative in the other), and the coefficients $V_A$, $V_B$, $V_C$ and $V_D$ are constants.

Preferably the potential $V_M$ is the potential at which the ions enter the electrostatic analyzer (ie, the potential of its entrance slit and its central trajectory). Alternatively a pair of the central electrodes adjacent to one another may be maintained at potentials respectively positive and negative relative to the potential at which the ions enter the analyzer.

The field E at any point in the central plane of the analyzer is therefore given by the polynomial expression:

$$E = E_o + E_1 Y_E + E_2 Y_E^2 + E_3 Y_E^3 + \quad (2)$$

In equation [2], $E_o$–$E_3$ are constants and $Y_E$ is the distance from the electrode maintained at $V_M$ measured in the central plane. It will be seen that in the case of linear electrodes the field generated by an analyzer according to the invention is essentially a linear field modified by higher order terms such as $E_2 Y_E^2$ and $E_3 Y_E^3$ which can be varied by adjustment of the potentials applied to the electrodes.

Preferably the coefficient $V_A$ is selected to set the deflection angle of the electrostatic analyzer and the coefficient $V_B$ is selected to set its focal length. Coefficients $V_c$ and $V_D$ may then be respectively selected to set the tilt and curvature of the image focal plane.

There are two ways whereby the extent of the spectrum imaged on a given length of the detector may be adjusted. First, it is dependent on the inclination of the detector to the direction of the ions as they leave the analyzer, because the dispersion of the analyzer is perpendicular to the direction of travel. Therefore, because the distance between the channels of the multichannel detector is fixed and is the limiting factor on spectral resolution, adjusting the constants $V_A$, $V_B$, $V_C$ and $V_D$ to set the focal plane at a particular angle and to make it substantially coincide with the face of the detector over the entire length of the detector results in the detector recording simultaneously a particular mass range at a particular resolution. If the detector is adjusted to an angle closer to the perpendicular to the direction of travel, and the constants $V_A$, $V_B$, $V_C$ and $V_D$ are readjusted to cause the focal plane to be realigned with it, then a greater mass range will be imaged simultaneously at a lower resolution. If the detector is rotated in the opposite direction a smaller mass range will be imaged at higher resolution. Obviously, the detector must be provided with some means of rotating its face to the correct angle, but this presents no particular difficulty.

Therefore in a preferred embodiment of the invention means are provided for setting the detector at least at two selected angles to the direction of travel of the ions as they leave the analyzer, and selecting the potentials applied to the electrodes of the electrostatic analyzer to cause its image focal plane to coincide with the detector over a substantial portion of the length of the detector, at least at one of the angles. If different sets of potentials are applied at the different detector angles it is of course possible to make the focal plane coincide with the detector at all the selected angles of the detector, thereby providing a variable dispersion mass spectrometer.

The second way in which the extent of the spectrum imaged can be varied is by varying the focal length of the electrostatic analyzer by adjusting the coefficient $V_B$ (equation [1]) and either moving a single detector to coincide with the new position of the focal plane or by providing two or more detectors at different distances from the analyzer. In the latter case, any detectors positioned between the final detector and the analyzer will have to be retracted to allow the final detector to be used. Focal plane tilt and curvature can simultaneously be adjusted by variation of the coefficients $V_C$ and $V_D$ to suit the particular detector selected.

Therefore in another embodiment the invention provides a mass spectrometer as defined above wherein the multichannel detector is translatable between two or more positions spaced from the electrostatic analyzer by different distances, and wherein the potentials applied to the electrodes are selected so that the image focal plane of the analyzer coincides with the multichannel detector over a substantial portion of its length at least at one of the positions.

It is also within the scope of the invention to use a combination of these two methods to adjust the extent of the spectrum imaged.

Preferably in a mass spectrometer according to the invention the momentum analyzer and the electrostatic analyzer will cooperate to form an image on the detector which is both direction and velocity focused (ie. is double focused) and the momentum analyzer will be a magnetic sector analyzer.

The most convenient way of selecting the electrode potentials in any spectrometer according to the invention is by the use of conventional computer ray-tracing programs. These programs allow the position and shape of the image focal plane to be predicted from a given set of electrode potentials by repetitively drawing the trajectories through the analyzer of ions of different energies and starting positions. An approximate set of potentials can therefore be established for any desired detector position, and final adjustment can be made on a complete spectrometer if means are provided for adjusting each potential within a narrow range. For example, the electrode potentials may be adjusted for maximum resolution over the entire mass range imaged.

The invention will now be described in greater detail by way of example only and by reference to the accompanying drawings, in which.

Figure 5:
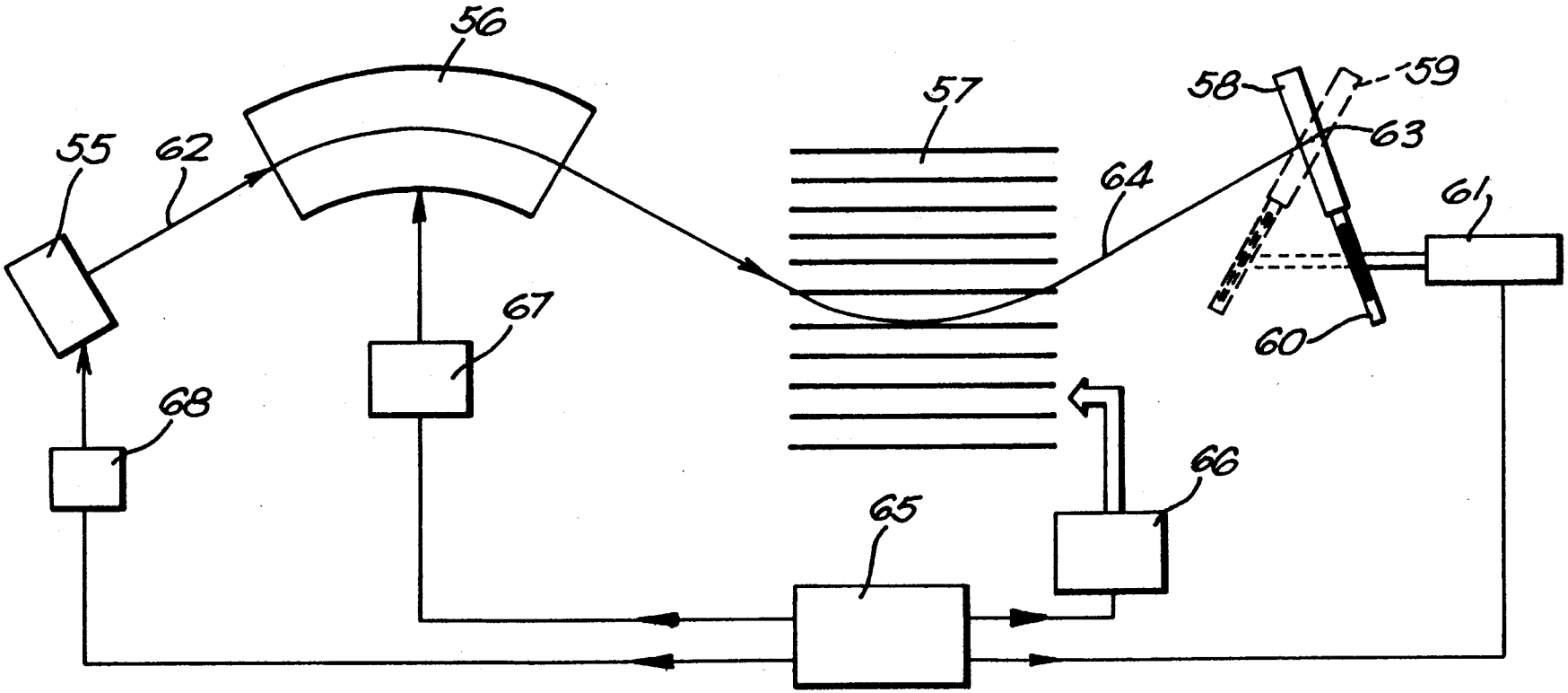
FIG. 5 is a schematic drawing of one type of mass spectrometer according to the invention;.

FIG. 5 illustrates a preferred type of variable dispersion mass spectrometer according to the invention. An ion source 55 emits a beam of ions 62 which passes in turn through a magnetic sector analyzer 56 and an electrostatic analyzer 57, discussed in detail below. A multichannel detector 58 fitted with a slotted link 60 is free to rotate on a pivot 63. A linear actuator 61 is coupled to the link 60 by means Of a peg which locates in its slot, permitting the detector to be set at various selected angles to the ion beam 64 which exits from the analyzer 57, for example to the position 59. In this way the detector 58 may be located in the image focal plane of the analyzer 57.

The magnetic sector analyzer 56 and electrostatic analyzer 57 are arranged so that they cooperate to produce an image on the detector 58 which is both direction and velocity focused, that is, as a conventional double focusing mass spectrometer. Electrical potentials are applied to the electrodes of analyzer 57 by the power supply 66 which is also discussed below. The magnetic sector analyzer 56 is supplied by power supply 67, and the ion source 55 by power supply 68. A computer 65 is used to control supplies 66, 67 and 68 and also the actuator 61. Computer 65 is programmed to set the angle of detector 58 to a particular value and simultaneously set the potentials on the electrodes of analyzer 57 (via the power supply 66) to values which result in the image-focal plane of analyzer 57 coinciding with the detector 58. As explained, setting the angle of the detector 58 to a particular angle to beam 64 controls the extent of the spectrum which is simultaneously imaged on the detector, and, because the channel spacing of the detector is constant, the resolution of the spectrum. In this way, an instrument which is capable of imaging either a large portion of the spectrum at Iow resolution or a smaller portion at high resolution can be produced.

Figure 6:
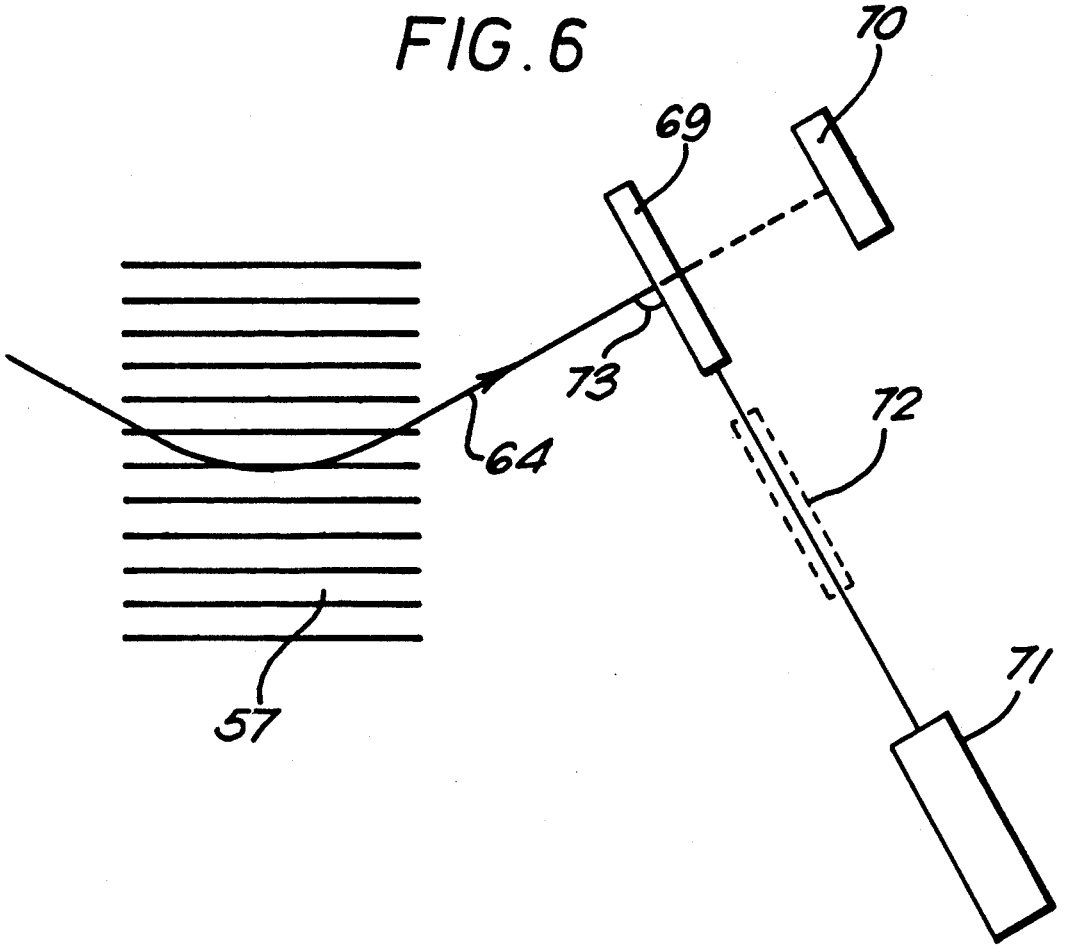
FIG. 6 is a schematic drawing showing an alternative type of ion detector suitable for use in the mass spectrometer shown in FIG. 5.

FIG. 6 shows an alternative arrangement of the detector system of the spectrometer of FIG. 5 wherein the tilting mechanism comprising items 58, 60 and 61 is replaced by a retractable multichannel detector 69 and an additional detector 70 which may either be another multichannel detector or a conventional single channel detector, for example an adjustable collector slit and an electron multiplier which allows operation of the spectrometer in the scanning mode. Means for allowing ions to pass unimpeded to the detector 70 comprise an actuator 71, capable of moving the detector 69 from a position wherein it intercepts the ion beam from the analyzer 57 to a position (for example 72) where it allows the ion beam to pass.

When the detector 69 is positioned to intercept the ion beam, the potentials applied to the electrodes comprising the electrostatic analyzer 57 are-adjusted to produce a focused spectrum on its surface. This is done by selecting the coefficient $V_B$ (equation [1]) to set the focal length of the analyzer and the coefficients $V_C$ and $V_D$ to optimize the focusing as described The angle 73 between the detector 69 and the ion beam 64 may be selected to ensure the best resolution of the spectral range to be imaged, as previously explained. In practice, there is likely to be an optimum angle 73 at which the total aberrations are a minimum, ie, when coefficients c and d are selected to minimize aberrations other than focal plane tilt and curvature, and obviously this is the preferred value for angle 73 providing that this permits adequate resolution and spectral range to be obtained on the particular detector in use.

When the detector 69 is retracted from the path of the ion beam, the mass spectrum is recorded using the detector 70. The coefficient $V_B$ is now adjusted so that the focal plane coincides with the detector 70 and the other coefficients in equation 1 selected to optimize the focusing as they are for detector 69. If the detector 70 is a single channel detector then the focal plane curvature and tilt are not as important and $V_C$ and $V_D$ may be selected to minimize other second and third order aberrations.

The spectrometer of FIG. 6 therefore allows a mass spectrum to be recorded at different dispersions on the two detectors because the dispersion depends on the focal length of the electrostatic analyzer. In a particularly preferred form the mass spectrometer geometry is optimized to provide a very high resolution scanning instrument when detector 70 is in use, and without making any compromises to the performance in this mode, to provide a very sensitive multichannel instrument when detector 69 is in use. Switching between the two modes involves merely changing the potentials on the electrodes of the analyzer 57 and moving the detector 69, both of which can be implemented easily and cheaply. Alternatively, if detector 70 is a second multichannel detector, a multichannel detector instrument having two different dispersions is produced, with the advantages outlined above. Obviously, more detectors located at different distances from the analyzer 57 can be provided if thought desirable The embodiments shown in FIGS. 5 and 6 may be regarded as two extremes of construction. Because the channel spacing of the detector is usually the parameter which controls the ultimate resolution, providing means exist for focusing the analyzer accurately on the detector wheresoever it is located a zoom effect can be obtained in either of the two ways. In the FIG. 5 embodiment, the detector is tilted at different angles to the beam, thereby exposing a different number of detector channels to the same extent of the spectrum. In the FIG. 6 embodiment, detectors are located at different distances from the analyzer to achieve the same overall effect. A mass spectrometer using an analyzer as described can take advantage of both methods, for example the tilting detector of FIG. 5 may be made retractable and a second detector 70 provided as in the FIG. 6 embodiment. This provides a particularly useful embodiment when detector 70 is a single channel detector. For conventional scanning high-resolution mass spectroscopy, detector 70 can be used to obtain the highest possible resolution. Simply by selecting a new set of potentials for the electrodes of analyzer 57 and moving detector 69 into the path of the ion beam, the instrument can be switched into a multichannel mode having variable resolution and mass range simply by tilting the detector 69. A high resolution-low mass range instrument is obtained when the detector is tilted at a shallow angle to the beam, and a low resolution-high mass range instrument is obtained when the detector is approximately perpendicular to the beam.

In another embodiment, a multichannel detector which can be translated along the direction of beam 64 may be provided, and means may also be provided to tilt it. Such a spectrometer can provide an extended "zoom" range without the expense of providing several retractable multichannel detectors.

Figure 1:
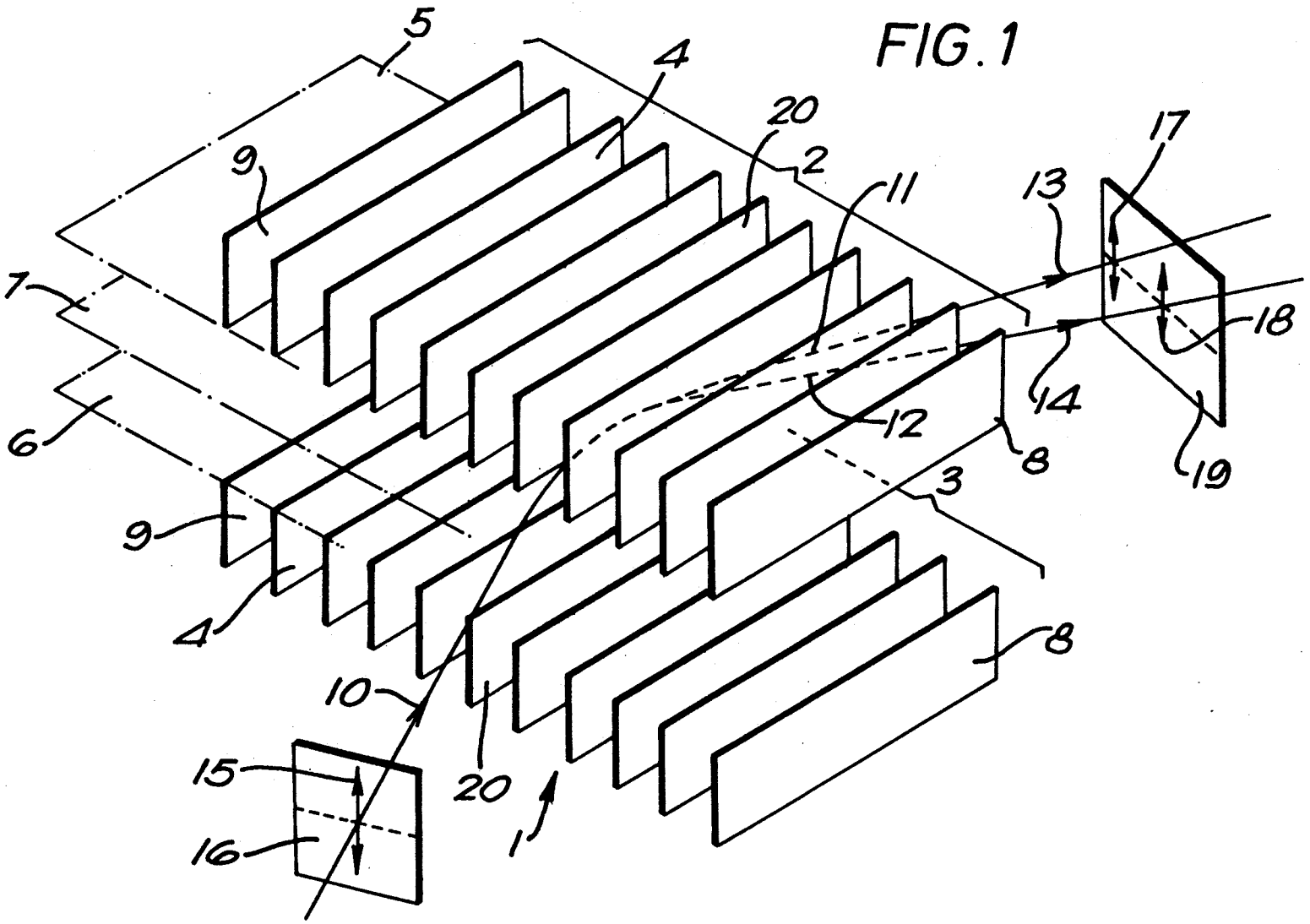
FIG. 1 is a schematic diagram of an electrostatic analyzer suitable for use in a mass spectrometer according to the invention.

Referring next to FIG. 1, an electrostatic analyzer suitable for use as the analyzer 57 in FIG. 5 is generally indicated at 1 and comprises two groups 2 and 3 of spaced-apart linear electrodes, (eg.4,8,9,20) respectively disposed in planes 5 and 6 which are parallel to the central plane 7 of the analyzer. Potentials are applied to the electrodes in such a way that they become progressively more positive from electrodes 8 through to electrodes 9, so that a beam of positive charged particles 10, incident as shown and travelling in the central plane 7 is deflected within the analyzer in curved trajectories (eg 11 and 12) according to the energy of the particles to form a group of energy dispersed charged-particle beams 13, 14 leaving the analyzer. In the analyzer shown the two groups 2 and 3 of electrodes are substantially identical and electrodes in one group are electrically connected to the corresponding electrode in the other group, thereby ensuring that there is substantially no field along any axis within the analyzer perpendicular to planes 5,6 and 7.

The field within the analyzer is such that an object 15 (defined, for example, by a narrow slit) located in the analyzer object plane 16 is focused to a series of energy dispersed images 17,18 in the analyzer image plane 19 according to the energy of the charged particles comprised in the beam 10. For example, charged particles of one energy are deflected along the curved trajectory 11 to form the image 17 and charged particles of a lower energy are deflected along the curved trajectory 12 to form the image 18 at a different place in the image focal plane 19. Because there is no field perpendicular to planes 5,6 and 7, the charged particles remain in the same plane in which they are travelling before they enter the analyzer. The potential of the central electrodes 20 of each group is typically maintained at the same potential as the entrance slit of the analyzer typically disposed in the object plane 16 and used to define the object 15.

The exact shape of the trajectory of ions through the analyzer will of course be dependent on the way in which the potential varies between the electrodes 4,8,9 and 20. If the potentials increase linearly from electrodes 8 through to electrodes 9, then positive ions will be deflected as shown in FIG. 1 and the trajectories 11 and 12 will be substantially parabolic. The field within the analyzer would then be substantially identical to that which would exist between two parallel straight electrodes disposed on either side of the ion beam. As explained, however, it is more useful to select the electrode potentials according to the polynomial expression $$V_E = V_M + V_A Y_E + V_B Y_E^2 + V_C Y_E^3 + V_D Y_E^4 + \quad (1)$$

where $V_E$ is the potential of a particular electrode, $V_M$ is the potential of the central electrode 20, $Y_E$ is the distance of that electrode from the central electrode, and $V_A$, $V_B$, $V_C$ and $V_D$ are constants.

Figure 2:
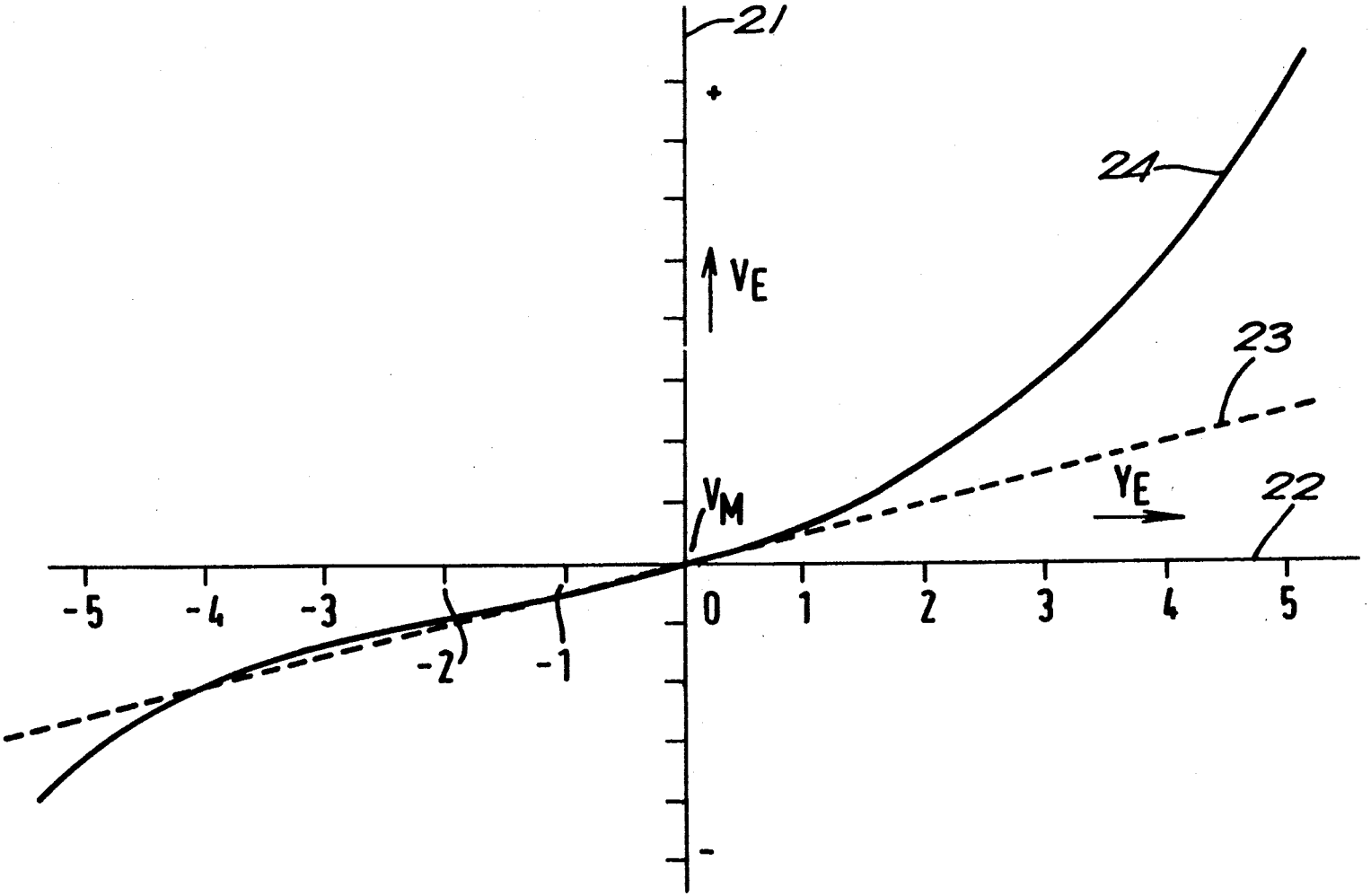
FIG. 2 is a plot of the potential of the electrodes comprising the analyzer of FIG. 1 in an exemplary case.

FIG. 2 is a plot of the potential on the electrodes relative to their position calculated using the constants $V_A=1.0$, $V_B=0.2$, $V_C=0.05$ and $V_D=0$, which are selected for illustrative purposes only. In FIG. 2, axis 21 represents the potential of the electrode $V_E$, and axis 22 the distance of the electrode from the central electrodes 20 ($Y_E$). The graph is drawn with its origin on the central electrode 20 (potential $V_M$, and $Y_E=0$). The broken line 23 represents a linear potential variation such as would be generated by two conventionally disposed main electrodes, and the curve 24 indicates the actual potential variation in an analyzer according to the invention for the constant values $V_A=1$, $V_B=0.2$, $V_c=0.05$ and $V_D=0$. Strictly, curve 24 will comprise a series of short straight lines linking points lying on the curve where the potential is defined by the electrode itself. Clearly, it is necessary to use a sufficient number of electrodes to ensure that the practical deviations from curve 24 do not significantly detract from the analyzer performance. Approximately eleven electrodes are sufficient for most applications, but advantage may be had in a very high performance spectrometer by using twice that number, resulting in more accurate definition of the inhomogeneous field.

It is not of course essential for the electrode defined above as the central electrode to be in the physical center of the array of electrodes. It is within the scope of the invention to provide more electrodes on one side of the electrical center than the other. Further, a pair of adjacently disposed electrodes, respectively maintained positive and negative with respect to the potential at which the ions enter the analyzer, may replace the single electrode 20 shown in the figures.

Figure 3:
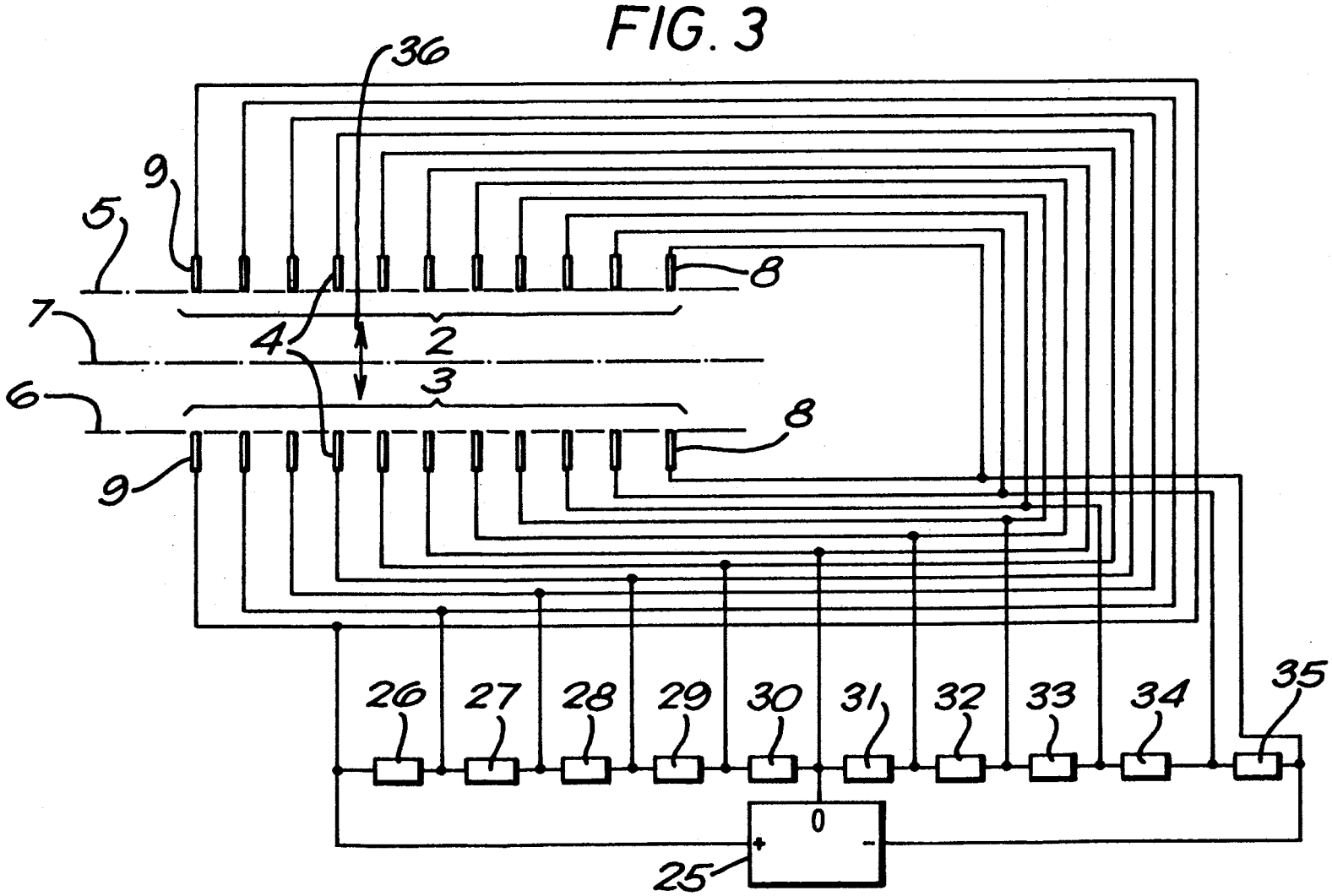
FIG. 3 is a circuit showing how the potentials may be applied to the electrodes of the analyzer of FIG. 1.

FIG. 3 illustrates an electrical circuit used to supply the required potentials to the electrodes 4,8,9 and 20 disposed as in FIG. 1. A power supply 25 provides equal positive and negative voltages to electrodes 8 and 9 as shown, and the central electrodes 20 are connected to the 0 volts connection of the supply, which is maintained at potential $V_M$, typically ground potential. The other electrodes 4 are fed by taps on a potential divider comprising resistors 26–35 which are selected so that the potential on each electrode is as defined by the curve 24 of FIG. 2. Also apparent from FIG. 3 is the connection of each electrode in the upper group 2 to the corresponding electrode in the lower group 3, thereby ensuring that there is substantially no field along an axis (eg 36, FIG. 3) perpendicular to planes 5,6, and 7.

If more than one set of electrode potentials is required, two or more chains of resistors may be provided and a multipole switch employed to change the electrode connections from one chain to the other when required.

In order to provide an easy means of adjusting the electrode potentials especially during optimization experiments, each electrode 4 may be connected to the sliding contact of a potentiometer which forms part of the potential divider. Alternatively, the potential of each electrode may be controlled digitally by means of a conventional voltage controlling circuit incorporating a digital-to-analog converter. A suitably programmed computer may then be employed to set the electrical potentials to whatever value is necessary. This method of controlling the electrode potentials is especially useful when many different sets of electrode potentials are required Referring next to FIG. 8, an electrostatic analyzer suitable for use in the invention and having fringing field correction comprises a main analyzer 82 similar to that illustrated in FIG. 1, an entrance fringing field corrector 85, and an exit fringing field corrector 88. The main analyzer 82 comprises an upper group of electrodes 83 and a lower group of electrodes 84. The electrodes comprised in each group 83 and 84 are maintained at progressively increasing potentials as previously described.

The entrance fringing field corrector 85 comprises an upper group of electrodes 86 and a lower group of electrodes 87, and the exit fringing field corrector 88 comprises similar groups 89 and 90. Each of the electrodes in groups 86, 87, 89 and 90 is aligned with an electrode in the groups 83 or 84 in order to obtain the best correction, and all the electrodes in groups 86, 87, 89 and 90 are maintained at the potential at which the ion beam enters the analyzer (typically ground potential). The side electrodes (eg, 91, 92 and 93) of each group, including those of the main analyzer 82, extend from the upper group (83, 86 or 89) through the central plane 94 of the analyzer to form the corresponding side electrode of the lower group (84, 87 or 90). These side electrodes provide fringing field correction at the sides of the analyzer and significantly reduce the interference to the electrostatic field inside the analyzer which might otherwise result from the proximity of a grounded vacuum enclosure. The electrodes in the groups 86, 87, 89 and 90 are typically approximately 25% of the lengths of the electrodes in the groups 83 and 84 which comprise the main analyzer 82.

Figure 4:
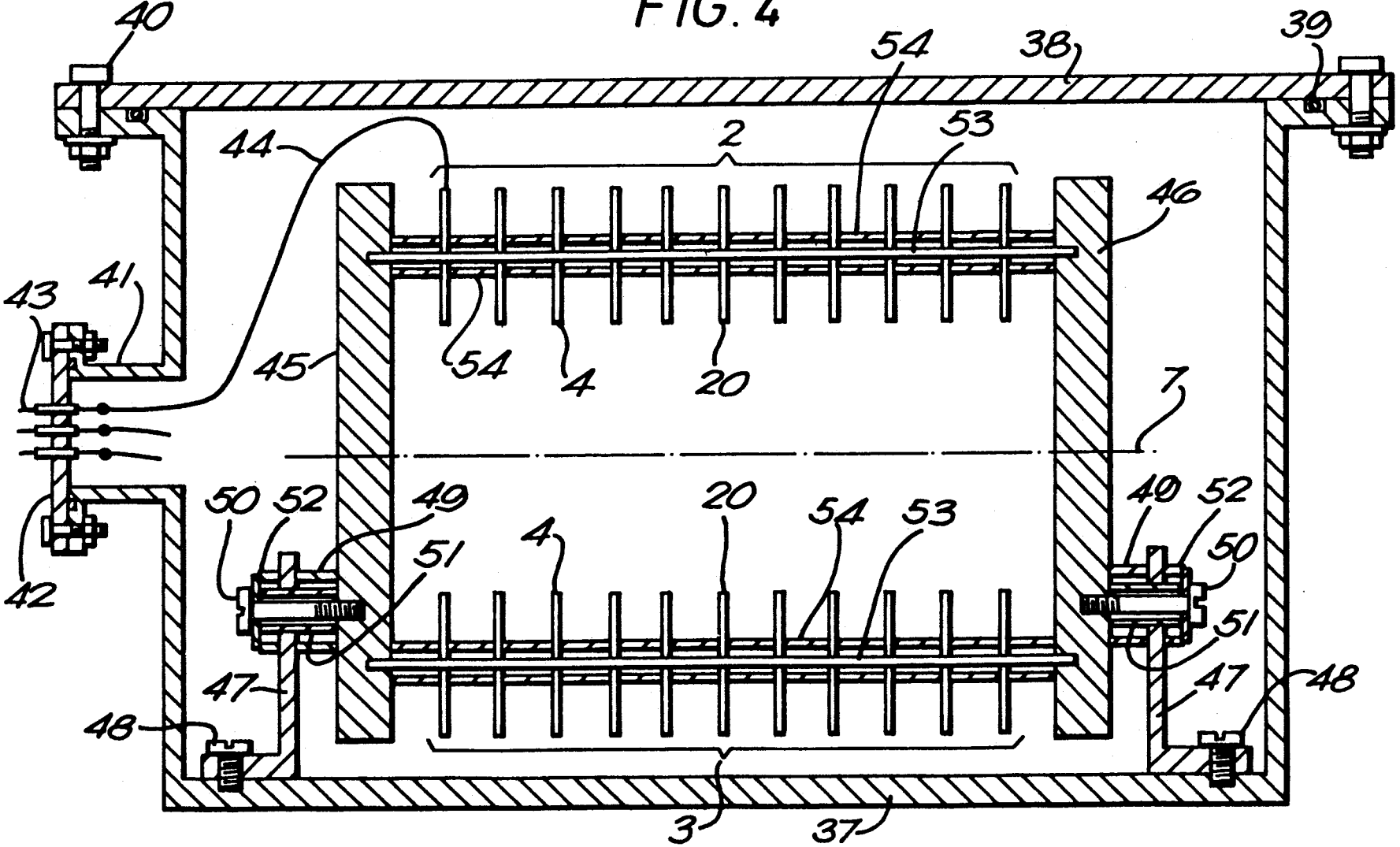
FIG. 4 is a sectional drawing illustrating a practical embodiment of the analyzer shown schematically in figure 1.

Referring next to FIG. 4, an electrostatic analyzer suitable for use in the invention is enclosed in a vacuum housing 37 closed by a lid 38 sealed with an 'O' ring 39 and secured by bolts 40. A port 41, closed by an 'O' ring sealed flange 42 which carries a number of electrical feedthroughs 43, is provided to allow electrical connection to be made to the electrodes comprising the analyzer (eg, lead 44).

The analyzer itself comprises two side electrodes 45, 46 which comprise rectangular straight plates which extend through the central plane 7 of the analyzer. Side electrodes 45, 46 comprise the end electrodes 8 and 9 of the schematically represented electrode structures of FIGS. 1 and 3. As explained, this provides fringing field correction at the sides of the analyzer and reduces the distance that the electrode structure needs to extend in order to ensure that the field is properly defined in the vicinity of the ion beam passing through the analyzer.

Side electrodes 45 and 46 are supported on four insulated mountings (two for each electrode) from brackets 47 which are secured to the floor of the vacuum housing 37 with screws 48. Each of the insulated mountings comprises a ceramic tube 49 and is secured by a screw 50 fitted with a ceramic sleeve 51, and a short ceramic tube 52 is fitted under the head of screw 50 as shown.

The upper group 2 and the lower group 3 of electrodes (eg, 4 20) are each supported on two ceramic rods 53 which are located in holes drilled in the side electrodes 45 and 46.

Figure 7:
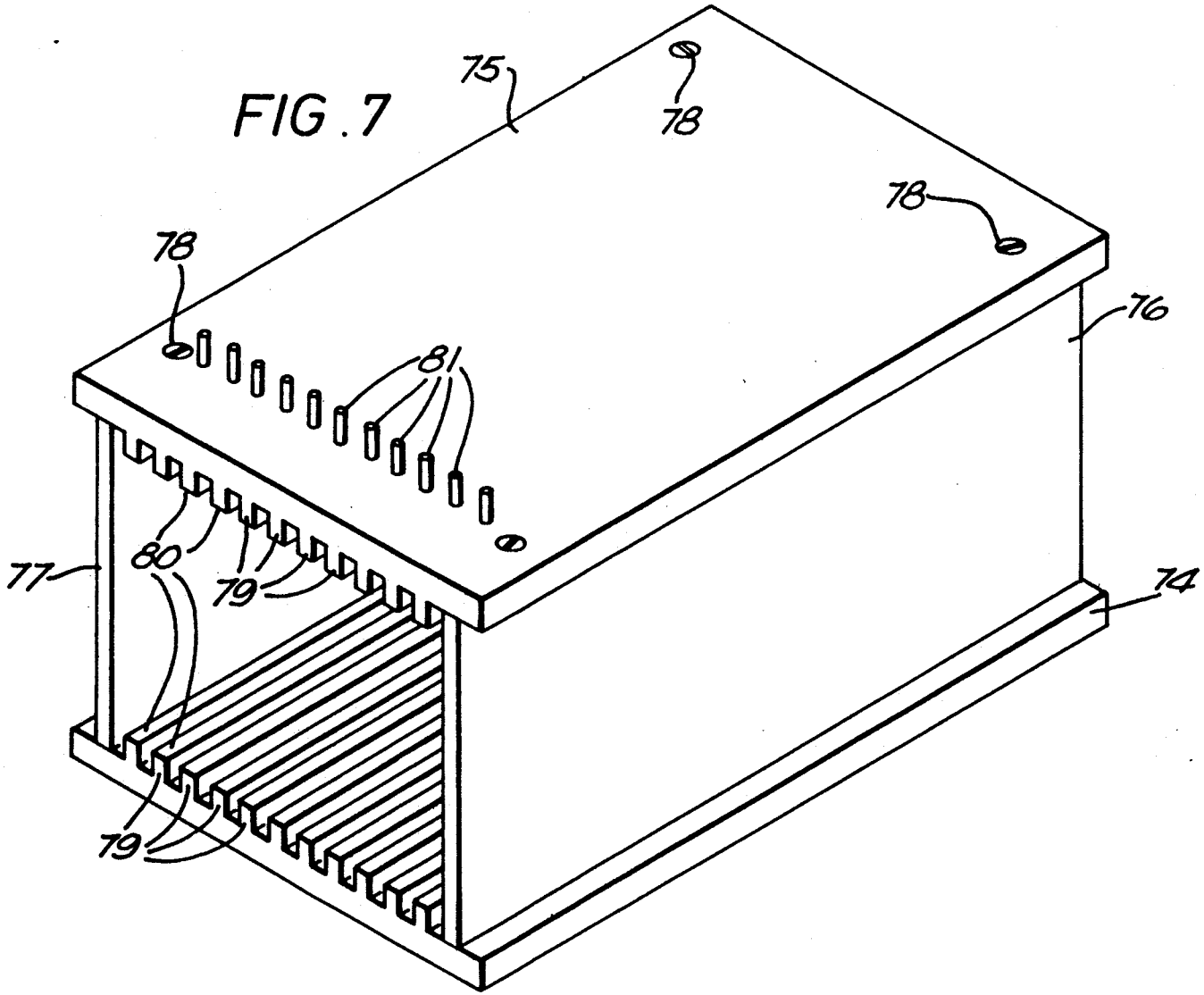
FIG. 7 is a drawing of an alternative form of construction of an electrostatic analyzer suitable for use in a spectrometer according to the invention.

Electrodes 4 are spaced apart by ceramic bushes 54 Each electrode 4 consists of a thin (eg 0.5 mm) rectangular metallic plate approximately the same length as the side electrodes. The height of the electrodes should be several times (eg, five to ten times) their spacing for the effect of fringing fields to be negligible. Typically, the electrodes may be spaced 5 mm apart An alternative was in which an analyzer according to the invention can be constructed is illustrated in FIG. 7. Two insulating (for example, ceramic) plates 74, 75 are spaced apart as shown by metallic side electrodes 76 77 which correspond to the side electrodes 45, 46 shown in FIG. 4. Screws 78 secure the insulating plates 74, 75 to the electrodes 76 and 77. Each plate 74, 75 comprises a series of ridges 79 which are parallel to the side electrodes 76 and 77 and which are coated with an electrically conductive deposit 80 (eg, a metallized film) to create the individual electrodes. Electrical connection is made to each electrode by means of the connection posts (eg 81) which pass through holes in the plate 75.

Figure 8:
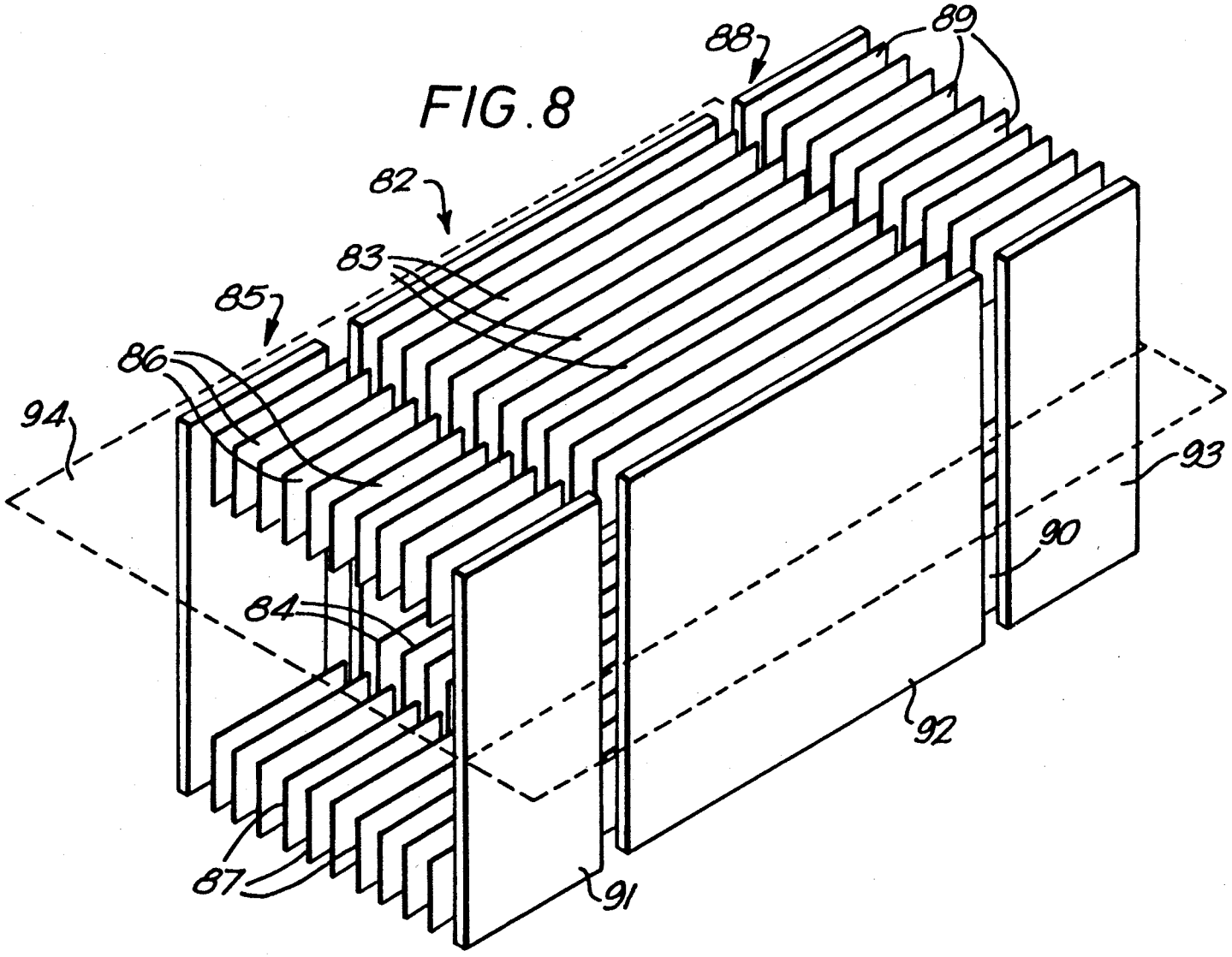
FIG. 8 is a drawing of a more preferred type of electrostatic analyzer suitable for use in a mass spectrometer according to the invention.

A similar method of construction may also be employed for the entrance and exit fringing field correctors (85 and 88, FIG. 8). A complete analyzer incorporating these can be manufactured economically by extending the insulating plates 74, 75 (FIG. 7) in the direction of the fringing field correctors and providing ridges similar to the ridges 79 on which the electrodes comprising the correction assemblies may be deposited.

Although the ridged structure illustrated in FIG. 7 is the most preferred form it is possible to form the electrodes simply by depositing metallic tracks on flat insulating plates. Analyzers so constructed are not suited to high performance applications, however.

Several types of multichannel detector are suitable for use in a spectrometer according to the invention Conveniently, one or more channelplate electron multipliers may be provided, followed by a phosphor screen. Light emitted by the phosphor is transmitted through a coherent fiber optic bundle to a position sensitive photodetector such as an array of photodiodes.

I claim:

1. A mass spectrometer comprising an ion source, an ion momentum analyzer, an electrostatic ion-energy analyzer and a multichannel detector locatable in the image focal plane of said electrostatic analyzer and capable of recording at least a portion of the mass spectrum of ions entering it, wherein said electrostatic analyzer comprises an upper and a lower group of spaced-apart electrodes respectively disposed above and below the ion beam passing through it, each said group of electrodes comprising a pair of electrodes between which one or more central electrodes are disposed, the potentials of one electrode of the pair being more positive and the other electrode of the pair being more negative than the potential at which ions comprised in said ion beam enter said electrostatic analyzer and the potentials of all the electrodes comprising each said group progressively increasing from one electrode to the next, thereby providing an electrostatic field in a central plane between said groups which is capable of deflecting said ions along different curved trajectories according to their energy, and wherein the potentials of said electrodes are further selected so that said image focal plane is coincident with said multichannel detector over at least a substantial portion of the length of said detector.

2. A mass-spectrometer as claimed in claim 1 wherein said potentials are further selected to cause a selected extent of said mass spectrum to be imaged on said detector.

3. A mass spectrometer comprising an ion source, an ion momentum analyzer, an electrostatic ion-energy analyzer and a multichannel detector locatable in the image focal plane of said electrostatic analyzer and capable of recording at least a portion of the mass spectrum of the ions entering it, wherein said electrostatic analyzer comprises two groups of spaced-apart electrodes respectively disposed above and below the ion beam passing through it, each said group of electrodes comprising a pair of electrodes between which one or more central electrodes are disposed, the potentials of each electrode of said pair being respectively more positive and more negative than the potential at which ions comprised in said ion beam enter said electrostatic analyzer and the potentials of all the electrodes comprising each said group progressively increasing from one electrode to the next, thereby providing an electrostatic field in a central plane between said groups which is capable of deflecting said ions along different curved trajectories according to their energy, and wherein the potentials of said electrodes are further selected to adjust the extent of the mass spectrum imaged on further a given length of said detector.

4. A mass spectrometer as claimed in claim 1 or 3 wherein said ion momentum analyzer and said electrostatic ion-energy analyzer cooperate to form an image in said image focal plane which is both direction and velocity focused.

5. A mass spectrometer as claimed in claims 1 or 3 wherein said electrodes are arrayed in a plane parallel to said central plane and are spaced from adjacent electrodes in the same group by a gap of constant width over the length of said electrode, and wherein said upper and lower groups are substantially identical.

6. A mass spectrometer as claimed in claim 5 wherein said electrodes are linear.

7. A mass spectrometer as claimed in claims 1 or 3 wherein one central electrode of each said group is maintained at a potential $V_M$ and the potential of the other electrodes in the group is given by the polynomial expression $$V_E = V_M + V_A Y_E + V_B Y_E^2 + V_C Y_E^3 + V_D Y_E^4 +$$

wherein $V_E$ is the potential of a particular electrode, $Y_E$ is the distance of said particular electrode from the electrode maintained at the potential $V_M$, and $V_A$, $V_B$, $V_C$ and $V_D$ are constants.

8. A mass spectrometer as claimed in claim 7 wherein $V_M$ is the potential at which the ions enter said electrostatic analyzer.

9. A mass spectrometer as claimed in claim 7 wherein the coefficients $V_A$ and $V_B$ are respectively selected to set the deflection angle and the focal length of said electrostatic ion-energy analyzer.

10. A mass spectrometer as claimed in claim 9 wherein the coefficients $V_C$ and $V_D$ are respectively selected to set the tilt and curvature of said image focal plane.

11. A mass spectrometer as claimed in claims 1 or 3 wherein means are provided for setting said multichannel detector at least at two selected angles to the direction of travel of ions as they leave said analyzer and said potentials are selected to cause said image focal plane to coincide with said multichannel detector over a substantial portion of its length at least at one of said selected angles.

12. A mass spectrometer as claimed in claim 11 wherein said image focal plane is caused to coincide with said detector over a substantial portion of its length at more than one of said selected angles by changing said potentials when the said selected angle is changed.

13. A mass spectrometer as claimed in claims 1 or 3 wherein said multichannel detector is translatable between two or more positions spaced from said electrostatic analyzer by different distances, and wherein said potentials are selected so that said image focal plane coincides with said detector over a substantial portion of its length at least at one of said positions.

14. A mass spectrometer as claimed in claims 1 or 3 wherein at least one additional detector is provided so that said additional detector and said multichannel detector are spaced at different distances from said electrostatic analyzer, selecting means are provided to set said potentials so that said image focal plane coincides with either said additional detector or said multichannel detector, and wherein any detectors located between said electrostatic analyzer and the detector farthest from it are provided with means for allowing ions to pass unimpeded from said analyzer to said detector farthest from it.

15. A mass spectrometer as claimed in claim 14 wherein said additional detector is a single-channel detector and wherein said spectrometer is capable of operation in the scanning mode when said image focal plane is coincident with said additional detector.

* * * * *

UNITED STATES PATENT AND TRADEMARK OFFICE

CERTIFICATE OF CORRECTION

PATENT NO. : 5,198,666

DATED : 30 March 1993

INVENTOR(S) : Bateman

It is certified that error appears in the above-identified patent and that said Letters Patent is hereby corrected as shown below:

In column 1, line 40, delete "beram" and insert --beam--.

In column 2, line 35, delete "Y-axis" and insert --y-axis--.

In column 4, line 18, delete "$V_{AyE}+V_{byE}{}^{2}$" and insert --$V_A Y_E+V_B Y_E{}^{2}$--.

In column 4, line 18, delete "$V_{DyE}{}^{4}$" and insert --$V_D Y_E{}^{4}$--.

In column 4, line 49, delete "$V_c$" and insert --$V_C$--.

In column 6, line 27, delete "Of" and insert --of--.

In column 7, line 5, delete "are-adjusted" and insert --are adjusted--.

UNITED STATES PATENT AND TRADEMARK OFFICE

CERTIFICATE OF CORRECTION

PATENT NO. : 5,198,666

DATED : 30 March 1993

INVENTOR(S) : Bateman

It is certified that error appears in the above-identified patent and that said Letters Patent is hereby corrected as shown below:

In column 7, line 9, insert --.-- after the word "described".

In column 11, line 4, delete "was" and insert --way--.

In column 11, line 7, insert --,-- after the numeral "76".

In column 11, line 31, insert --.-- after the word "invention".

In column 12, line 22, delete "claim" and insert --claims--.

Signed and Sealed this

Twelfth Day of April, 1994

Bruce Lehman

*Attest:*

BRUCE LEHMAN

*Commissioner of Patents and Trademarks*

*Attesting Officer*

UNITED STATES PATENT AND TRADEMARK OFFICE

CERTIFICATE OF CORRECTION

PATENT NO. : 5,198,666

DATED : 30 March 1993

INVENTOR(S) : Bateman

It is certified that error appears in the above-identified patent and that said Letters Patent is hereby corrected as shown below:

In column 1, line 40, delete "beram" and insert --beam--.

In column 2, line 35, delete "Y-axis" and insert --y-axis--.

In column 4, line 18, delete "$V_E=V_M+V_{AyE}+V_{byE}^2+V_CY_E^3+V_{DyE}^4$" and insert --$V_E=V_M+V_{AyE}+V_{ByE}^2+V_CY_E^3+V_{DyE}^4$--.

In column 4, line 36, delete "$E=E_o+E_1Y_E+E_2Y_E^2+E_3Y_E^3+$" and insert --$E=E_o+E_1y_E+E_2y_E^2+E_3y_E^3+$--.

In column 4, line 38, delete "$Y_E$" and insert --$y_E$--.

In column 4, line 43, delete "$E_2Y_E^2$" and insert--$E_2y_E^2$--.

In column 4, line 44, delete "$E_3Y_E^3$" and insert--$E_3y_E^3$--.

In column 4, line 49, delete "$V_c$" and insert --$V_C$--.

In column 6, line 27, delete "Of" and insert --of--.

In column 7, line 5, delete "are-adjusted" and insert --are adjusted--.

In column 7, line 9, insert --.-- after the word "described".

UNITED STATES PATENT AND TRADEMARK OFFICE
CERTIFICATE OF CORRECTION

PATENT NO. : 5,198,666

DATED : 30 March 1993

INVENTOR(S) : Bateman

It is certified that error appears in the above-identified patent and that said Letters Patent is hereby corrected as shown below:

In column 8, line 68, delete "$V_E=V_M+V_AY_E+V_BY_E^2+V_CY_E^3+V_DY_E^4+$" and insert --$V_E=V_M+V_AY_E+V_BY_E^2+V_CY_E^3+V_DY_E^4+$--.

In column 9, line 3, delete "$Y_E$" and insert --$y_E$--.

In column 9, line 12, delete "$Y_E$" and insert --$y_E$--.

In column 9, line 13, delete "$Y_E$" and insert --$y_E$--.

In column 9, line 19, delete "$V_c$" and insert --$V_C$--.

In column 11, line 4, delete "was" and insert --way--.

In column 11, line 7, insert --,-- after the numeral "76".

In column 11, line 31, insert --.-- after the word "invention".

In column 12, line 22, delete "claim" and insert --claims--.

In column 12, line 41, delete "$V_E=V_M+V_AY_E+V_BY_E^2+V_CY_E^3+V_DY_E^4+$" and insert --$V_E=V_M+V_AY_E+V_BY_E^2+V_CY_E^3+V_DY_E^4+$--.

UNITED STATES PATENT AND TRADEMARK OFFICE

CERTIFICATE OF CORRECTION

PATENT NO. : 5,198,666

DATED : 30 March 1993

INVENTOR(S) : Bateman

It is certified that error appears in the above-identified patent and that said Letters Patent is hereby corrected as shown below:

In column 12, line 44, delete "$Y_E$" and insert --$y_E$--.

Signed and Sealed this

Tenth Day of May, 1994

*Attest:*

*Attesting Officer*

Bruce Lehman

BRUCE LEHMAN

*Commissioner of Patents and Trademarks*